US011411302B2

(12) United States Patent
Jiang et al.

(10) Patent No.: US 11,411,302 B2
(45) Date of Patent: Aug. 9, 2022

(54) 5G ANTENNA UNIT AND 5G ANTENNA

(71) Applicants: ROSENBERGER TECHNOLOGIES CO., LTD., Suzhou (CN); Rosenberger Technologies LLC, Budd Lake, NJ (US)

(72) Inventors: Tao Jiang, Suzhou (CN); Dele Wang, Suzhou (CN); Mingbo Qi, Suzhou (CN); Shouhong Cai, Suzhou (CN); Jing Sun, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/505,277

(22) Filed: Oct. 19, 2021

(65) Prior Publication Data

US 2022/0037770 A1 Feb. 3, 2022

Related U.S. Application Data

(63) Continuation of application No. PCT/CN2020/095325, filed on Jun. 10, 2020.

(51) Int. Cl.

| | |
|---|---|
| ***H01Q 1/24*** | (2006.01) |
| ***H01Q 9/04*** | (2006.01) |
| ***H01Q 21/24*** | (2006.01) |

(52) U.S. Cl.

CPC ..... *H01Q 1/246* (2013.01); *H01Q 1/24* (2013.01); *H01Q 9/04* (2013.01); *H01Q 9/0457* (2013.01); *H01Q 21/24* (2013.01)

(58) Field of Classification Search

CPC ..... H01Q 1/246; H01Q 21/26; H01Q 19/24; H01Q 1/24; H01Q 9/0457; H01Q 9/04; H01Q 21/24

(Continued)

(56) References Cited

U.S. PATENT DOCUMENTS 5,691,734 A * 11/1997 Davies ..... H01Q 9/045 343/795
2005/0253769 A1* 11/2005 Timofeev ..... H01Q 21/26 343/797

(Continued)

FOREIGN PATENT DOCUMENTS

CN 109216911 A 1/2019
CN 110011027 A 7/2019

(Continued)

*Primary Examiner* — Hai V Tran

(74) *Attorney, Agent, or Firm* — Anova Law Group, PLLC

(57) ABSTRACT

A 5G antenna unit includes: a feed stalk including two support plates intersected with each other; a radiation structure disposed at a first end of the feed stalk and including a radiation surface away from the first end of the feed stalk; and a feed board disposed at a second end of the feed stalk. One end of each of the two support plates adjacent to the radiation structure partially passes through the radiation surface of the radiation structure to fix and support the radiation structure. Each support plate is provided with at least two feed lines for coupling with the radiation surface. An end surface of the feed board adjacent to the feed board is provided with a feed network including a plurality of feed points. Each feed point is electrically connected to one of the feed lines to form a feeding structure including at least two feed points of the plurality of feed points.

15 Claims, 3 Drawing Sheets

(58) Field of Classification Search
USPC ..... 343/878
See application file for complete search history.

(56) References Cited

U.S. PATENT DOCUMENTS

| | | | | |
|---|---|---|---|---|
| 2012/0146872 | A1* | 6/2012 | Chainon | H01Q 19/24 343/818 |
| 2015/0084823 | A1* | 3/2015 | Wang | H01Q 21/26 343/797 |
| 2018/0337462 | A1* | 11/2018 | Vollmer | H01Q 13/10 |
| 2019/0326672 | A1 | 10/2019 | Lim et al. | |
| 2020/0067205 | A1* | 2/2020 | Segador Alvarez | H01Q 21/26 |

FOREIGN PATENT DOCUMENTS

| | | | |
|---|---|---|---|
| CN | 209282396 | U | 8/2019 |
| CN | 210015944 | U | 2/2020 |
| CN | 111129750 | A | 5/2020 |
| CN | 210723342 | U | 6/2020 |
| CN | 111430905 | A | 7/2020 |

* cited by examiner

5G ANTENNA UNIT AND 5G ANTENNA

CROSS-REFERENCE TO RELATED APPLICATION

This application is a continuation application of PCT application PCT/CN2020/095325, filed on Jun. 10, 2020, the entire content of which is incorporated herein by reference.

TECHNICAL FIELD

The present disclosure relates to the technical field of communications, and more particularly, to a 5G antenna unit and a 5G antenna.

BACKGROUND

With the needs of social development, mobile communication technology grows rapidly. As Internet of Things and $5^{th}$ generation (5G) communication systems are widely deployed, a new era of Internet of Everything is arriving. With its high speed, large capacity, and low latency characteristics, the 5G communication systems can satisfy people's needs for ultra large traffic network connections, ultra large number of device connections, and ultra high mobility.

Antennas which server as carriers of the 5G network communication applications are improved rapidly as the communication technology advances. However, an existing 5G antenna unit often includes the following disadvantages: the frequency band of an antenna array is too narrow, the manufacturing cost of the antenna unit is too high, and the antenna unit is too heavy; the space occupied by the antenna unit of a 5G base station is too large to be miniaturized, and the signal loss of the antenna unit is too large; the existing 5G antenna unit often has a direct feeding structure, which is difficult to assemble and may be subject to passive intermodulation, resulting unstable performance.

SUMMARY

In accordance with the disclosure, a 5G antenna unit is provided. The 5G antenna unit comprises: a feed stalk including two support plates intersected with each other; a radiation structure disposed at a first end of the feed stalk and including a radiation surface away from the first end of the feed stalk; and a feed board disposed at a second end of the feed stalk. One end of each of the two support plates adjacent to the radiation structure partially passes through the radiation surface of the radiation structure to fix and support the radiation structure. Each support plate is provided with at least two feed lines for coupling with the radiation surface. An end surface of the feed board adjacent to the feed stalk is provided with a feed network including a plurality of feed points. Each feed point is electrically connected to one of the feed lines to form a feeding structure containing the plurality of feed points.

Also in accordance with the disclosure, a 5G antenna is provided. The 5G antenna includes at least one 5G antenna unit. The 5G antenna unit includes: a feed stalk including two support plates intersected with each other; a radiation structure disposed at a first end of the feed stalk and including a radiation surface away from the first end of the feed stalk; and a feed board disposed at a second end of the feed stalk. One end of each of the two support plates adjacent to the radiation structure partially passes through the radiation surface of the radiation structure to fix and support the radiation structure. Each support plate is provided with at least two feed lines for coupling with the radiation surface. An end surface of the feed board adjacent to the feed stalk is provided with a feed network including a plurality of feed points. Each feed point is electrically connected to one of the feed lines to form a feeding structure containing the plurality of feed points.

BRIEF DESCRIPTION OF THE DRAWINGS

To more clearly illustrate the technical solution of the present disclosure, the accompanying drawings used in the description of the disclosed embodiments are briefly described hereinafter. The drawings described below are merely some embodiments of the present disclosure. Other drawings may be derived from such drawings by a person with ordinary skill in the art without creative efforts and may be encompassed in the present disclosure.

DESCRIPTION OF NUMERALS IN THE DRAWINGS

Figure 1:
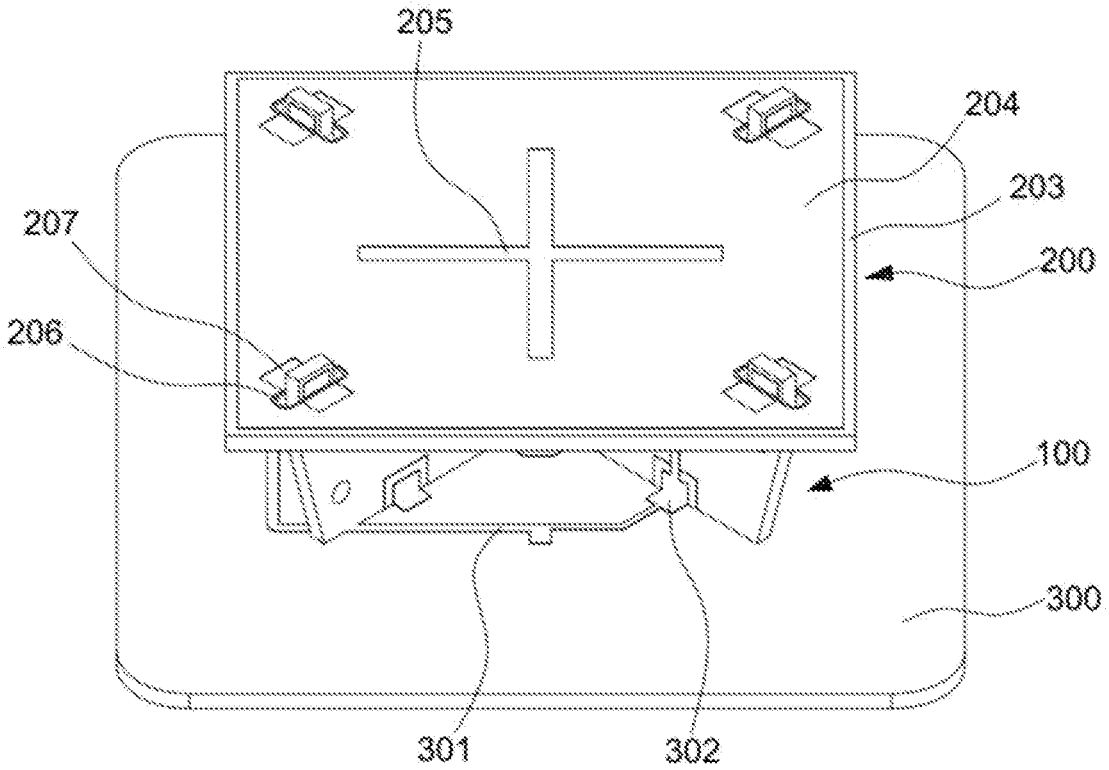
FIG. 1 is a three-dimensional structural diagram of an assembled 5G antenna unit according to an example embodiment of the present disclosure.

100 feed stalk
101 first support plate
102 second support plate
103 first slot
104 second slot
105 cross axis
106 first fixing protrusion
107 second fixing protrusion
108 first feed line
109 second feed line
110 third feed line
111 fourth feed line
112 first feed part
113 second feed part
114 third feed part
115 feed connection part
200 radiation structure
201 first upper surface
202 first lower surface
203 base plate
204 director
205 cross slotted structure/cross stripped copper structure
206 snap slot
207 soldering pad
300 feed board
301 feed network
302 feed point
303 conductive path Other features, characteristics, advantages, and benefits of the present disclosure will become more apparent through the following detailed description with reference to accompanying drawings.

DETAILED DESCRIPTION OF THE EMBODIMENTS

Embodiments of the present disclosure are described in detail below with reference to the accompanying drawings. Same or similar reference numerals in the drawings represent the same or similar elements or elements having the same or similar functions throughout the specification. It will be appreciated that the described embodiments are some rather than all of the embodiments of the present disclosure. Other embodiments obtained by those having ordinary skills in the art on the basis of the described embodiments without inventive efforts should fall within the scope of the present disclosure.

Figure 2:
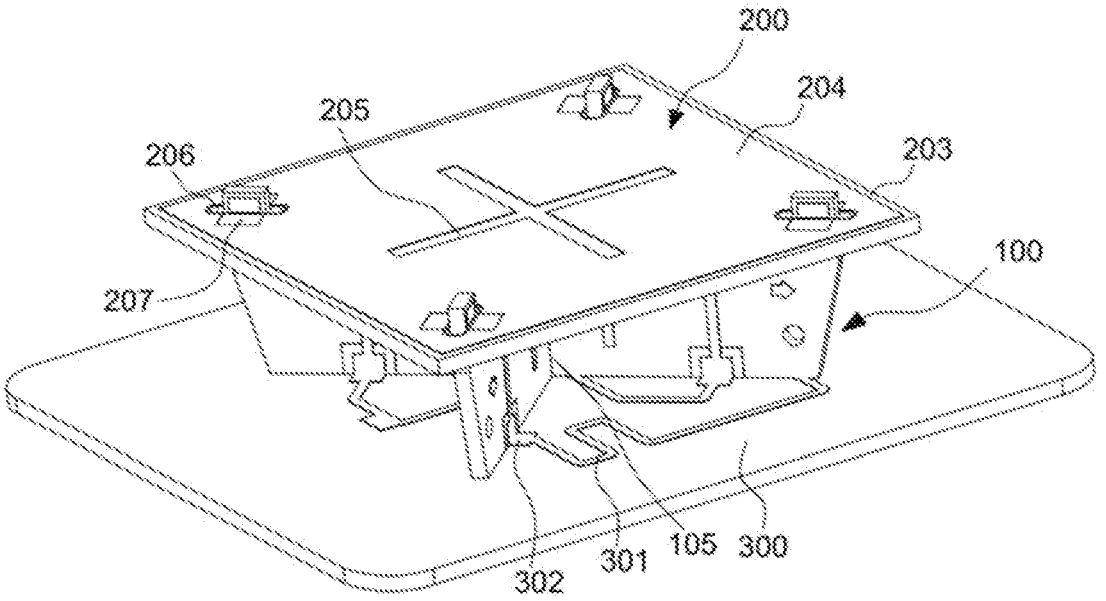
FIG. 2 is a three-dimensional structural diagram of an assembled 5G antenna unit viewed from another perspective according to an example embodiment of the present disclosure.
Figure 3:
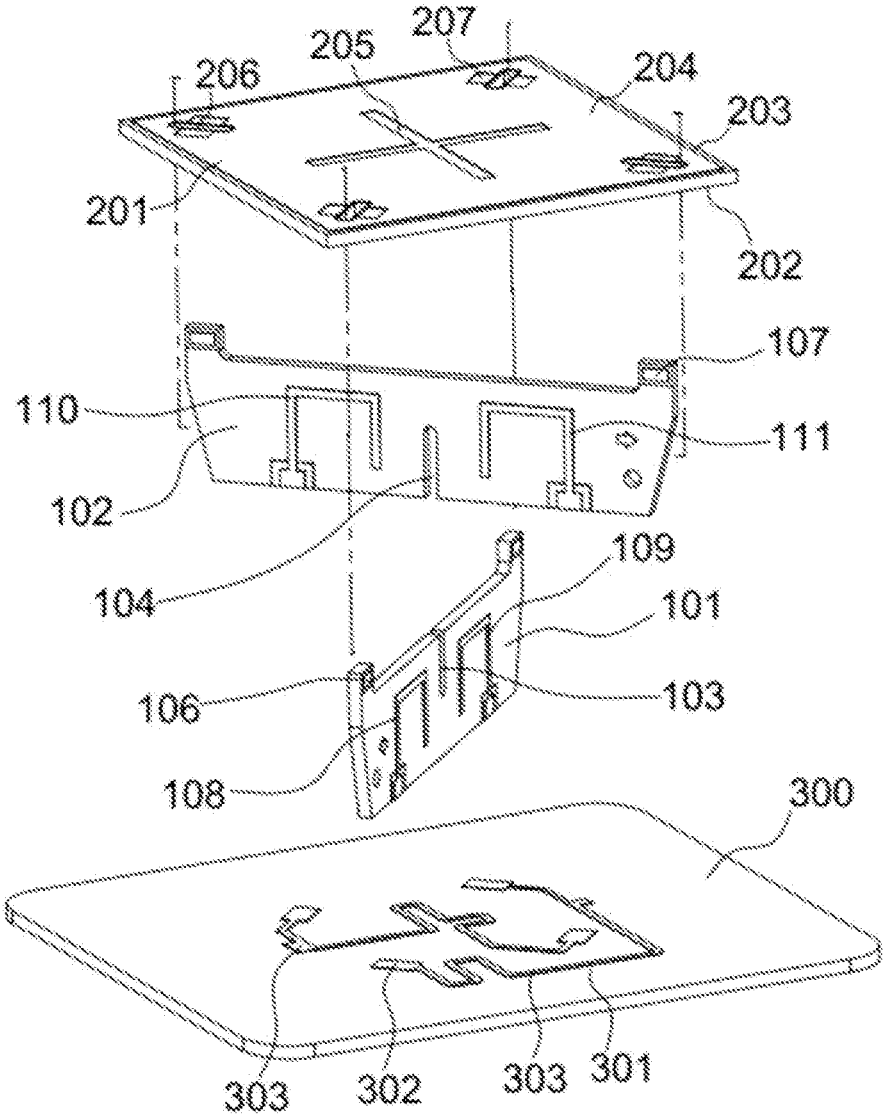
FIG. 3 is an exploded structural diagram of a 5G antenna unit according to another example embodiment of the present disclosure.

The present disclosure provides a 5G antenna unit. As shown in FIGS. 1-3, the 5G antenna unit includes a feed stalk 100, a radiation structure 200 disposed at a first end of the feed stalk 100, and a feed board 300 disposed at a second end of the feed stalk 100.

In some embodiments, as shown in FIG. 3, the radiation structure 200 is arranged horizontally and includes a first upper surface 201 and a first lower surface 202 arranged opposite to each other. The first upper surface 201 is a radiation surface. The radiation surface may be square-shaped, circle-shaped, or in another shape. In some embodiments, the radiation structure 200 includes a base plate 203 and a director 204 disposed on an upper surface of the base plate 203. An upper surface of the director 204 is also referred as a radiation surface. The director 204 is square-shaped. In some embodiments, the radiation structure 200 may be one of a printed circuit board (PCB), an electroplated plastic plate, or a sheet metal plate.

In some embodiments, a cross slotted structure/etched cross stripped copper structure 205 concaves at a thickness direction of the radiation structure 200. In other words, the cross slotted structure or the cross stripped copper structure is a recessed portion of the radiation structure 200 at a thickness direction. In some embodiments, the center of the cross slotted structure/cross stripped copper structure 205 coincides with the center of the radiation surface 201. One slot of the cross slotted structure 205 is arranged parallel with a horizontal edge of the radiation surface 201. Another slot is arranged parallel with a vertical edge of the radiation surface 201. In some embodiments, one stripped copper structure of the cross stripped copper structure 205 is arranged parallel with the horizontal edge of the radiation surface 201. Another stripped copper structure is arranged parallel with the vertical edge of the radiation surface 201. Here, a vertical edge may refer to an edge at a length direction, and a horizontal edge may refer to an edge at a width direction.

When the radiation structure 200 is the PCB board or the electroplated plastic plate, the cross stripped copper structure 205 is disposed at the thickness direction of the radiation structure 200. When the radiation structure 200 is the sheet metal plate, the cross slotted structure 205 is disposed at the thickness direction of the radiation structure 200. The cross slotted structure/cross stripped copper structure 205 disposed at the radiation structure 200 facilitates impedance matching and frequency band adjustment of antenna elements.

The feed stalk 100 is vertically disposed under the radiation structure 200, and top ends of feed stalk 100 pass through the radiation surface 201 of the radiation structure 200. In some embodiments, the feed stalk 100 includes two support plates. Each support plate is vertically arranged, that is, perpendicular to the radiation structure 200. For illustration purpose, the two support plates are a first support plate 101 and a second support plate 102, respectively. The first support plate 101 is arranged along one diagonal line of the radiation surface 201. The second support plate 102 is arranged along another diagonal line of the radiation surface 201. The two support plates are intersected with each other. The two support plates not only play a role of fixing and supporting the radiation structure 200, but also play a role of coupling feed signals.

A slot is arranged vertically on each support plate. The two support plates are inserted into each other crosswise through the respective slots. Specially, a first slot 103 is formed from a top end toward a middle portion of the first support plate 101, and a second slot 104 is formed from a bottom end of toward a middle portion of the second support plate 102. The first slot 103 and the second slot 104 are intersected with each other to form a cross of the two support plates. After the intersection, the upper ends and the lower ends of the two support plates are flushed with each other. A cross axis 105 of the two intersected support plates is located on an extension line of a central axis of the radiation surface 201.

The upper ends of the two support plates are fixed and confined to the radiation structure 200 by the structure matching the fixing protrusions with the snap slots. Specifically, a first fixing protrusion 106 is disposed at each of a left side and a right side of the upper end of the first support plate 101, respectively. The first fixing protrusion 106 is formed by extending upward from the upper end of the first support plate 101. The first fixing protrusions 106 on the first support plate 101 are symmetrically arranged with respect to the cross axis 105 of the feed stalk 100. Similarly, a second fixing protrusion 107 is disposed at each of a left side and a right side of the upper end of the second support plate 102, respectively. The second fixing protrusion 107 is formed by extending upward from the upper end of the second support plate 102. The second fixing protrusions 107 on the second support plate 101 are symmetrically arranged with respect to the cross axis 105 of the feed stalk 100. The four fixing protrusions on the feed stalk 100 are rotationally symmetrical with respect to the cross axis 105.

Correspondingly, a snap slot 206 is disposed at each of the positions on the radiation structure 200 corresponding to the four fixing protrusions of the feed stalk 100 for allowing a corresponding fixing protrusion to pass through. The four snap slots 206 on the radiation structure 200 are rotationally symmetrical with respect to the central axis of the radiation structure 206. In some embodiments, the four snap slots 206 are respectively disposed adjacent to the four corners of the radiation structure 200.

After passing through the snap slot 206, the fixing protrusion on the feed stalk 100 are fixedly connected to the radiation surface 201 of the radiation structure 200 by means of glue or soldering. In some embodiments, a soldering pad 207 is disposed at the periphery of each snap slot 206 on the radiation surface 201. The fixing protrusions on the feed stalk 100 are fixedly connected to the soldering pads 207 by soldering. The fixing protrusions on the feed stalk 100 not only provide the fixing function, but also confine the radiation structure 200 to the upper ends of the support plates.

Two feed lines are disposed at one of the surfaces of each support plate perpendicular to the radiation structure 200. In this case, four feed lines are disposed on the two support plates. For illustration purpose, the four feed lines include a first feed line 108, a second feed line 109, a third feed line 110, and a fourth feed line 111. The first feed line 108 and the second feed line 109 are disposed at a vertical surface of the first support plate 101 and arranged on both sides of the first slot 103 symmetrically with respect to the first slot 103. The third feed line 110 and the fourth feed line 111 are disposed at a vertical surface of the second support plate 102 and arranged on both sides of the second slot 104 symmetrically with respect to the second slot 104.

Figure 4:
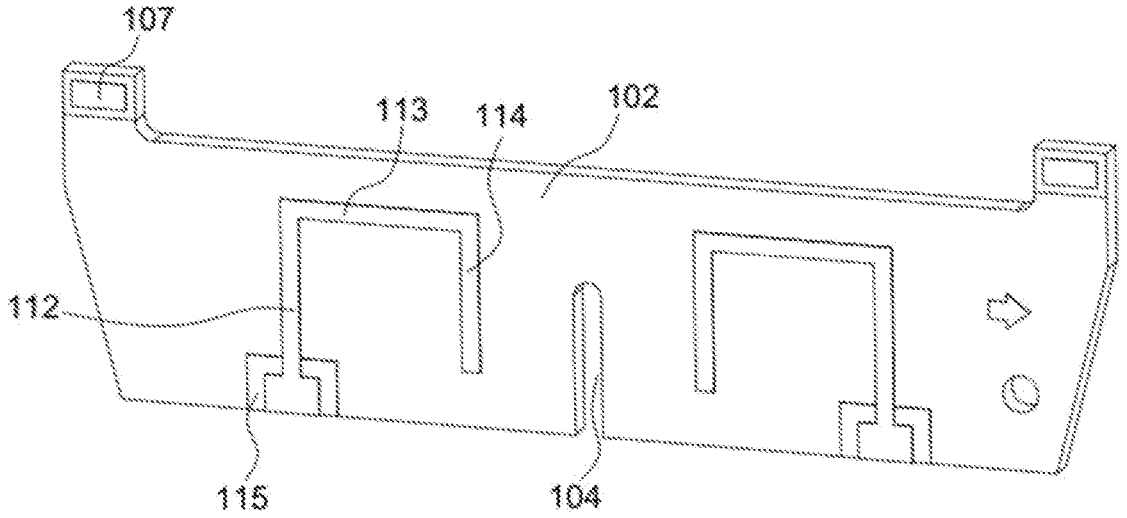
FIG. 4 is a structural diagram of a second support plate according to an example embodiment of the present disclosure.

Each feed line performs coupling feeding to the radiation surface 201. That is, the feed lines are not directly connected to the radiation surface 201. Instead, the feed lines couple with the radiation surface 201 at four points of the radiation surface 201. In some embodiments, as shown in FIG. 4, the feed lines are U-shaped and are formed by etching on the support plates. Each feed line includes a first feed part 112, a second feed part 113, and a third feed part 114. The first feed part 112 is arranged vertically and formed by extending upward from the lower end of the support plate. The lower end of the first feed part 112 includes a feed connection part 115 and the upper end thereof does not extend to the upper end of the support plate. The second feed part 113 is formed by extending horizontally from the upper end of the first feed part 112 toward the slot on the support plate. The third feed part 114 is formed by extending vertically from an end of the second feed part 113 adjacent to the slot toward the lower end of the support plate. The lower end of the third feed part 114 does not extend to the lower end of the support plate. As such, the first feed part 112, the second feed part 113, and the third feed part 114 are connected to form a U shape. The U-shaped feed lines are desired for antenna array matching and soldering. In some embodiments, the feed lines can be used to expand an operating bandwidth of the antenna. The feed lines are coupled with the director 204 to stabilize the passive intermodulation easily. In addition, adopting coupling as a feeding method facilitates the antenna to achieve a higher degree of isolation.

In some embodiments, the U-shaped feed lines may be replaced by 1-shaped feed lines (not shown). The upper ends of the 1-shaped feed lines may be directly connected to (for example, through soldering) the director 204 of the radiation structure 200 to feed. In this case, the two support plates may be implemented by using two PCB boards.

The feed board 300 disposed at the lower end of the feed stalk 100 is arranged horizontally, and parallel with the radiation structure 200. A feed network 301 is arranged on an upper surface of the feed board 300 (i.e., the surface adjacent to the support plates). The feed network 301 includes two conductive paths 303. Each conductive path 303 includes two feed points 302 at both ends of the conductive path 303. That is, the feed network 301 includes four feed points 302. Each feed point 302 corresponds to and is electrically connected to one of the feed connection parts 115 of a feed stalk. A four-point feeding structure is formed by feeding from the feed lines to the director 204 on the radiation structure 200. In some embodiments, the feed board 300 may be implemented by using a PCB board.

In the embodiments of the present disclosure, a PCB-PCB combination structure or a PCB-metal plate combination structure effectively enhances structural strength of the antenna, improves manufacturing flexibility, and reduces an overall weight of the antenna. In addition, the adoption of the PCB board may adjust a contour and structure of the antenna flexibly. Thus, electrical characteristics of the antenna, such as operating frequency band, the operating impedance, S-parameter, and antenna azimuth plan, may be flexibly adjusted without the need for opening a mold. In addition, the antenna array includes the four-point feeding structure to readily achieve the electrical characteristics, such as a higher crossover plan and impedance matching, thereby doubling the bandwidth of the antenna. In addition, the 5G antenna unit in the present disclosure includes not only a miniaturization feature of the sheet metal or the die-casting array and an automatic production patching, but also an easy assembling feature of traditional low profile PCB array, and also brings an increase in the bandwidth of the feeding structure. It takes less time to design and develop the PCB array that can be easily adjusted.

The present disclosure also provides a 5G antenna including the above-described 5G antenna unit. The 5G antenna also includes the characteristics of having a wider operating bandwidth, being miniaturized, and being easy to assemble. The 5G antenna is easy to assemble and use to make designing a broadband 5G antenna feasible.

The beneficial effects of the present disclosure include: 1) a PCB-PCB combination structure or a PCB-metal plate combination structure improves manufacturing flexibility, and reduces an overall weight of the antenna; 2) a coupling feeding structure expands an operating bandwidth of the antenna, makes it easy to stabilize passive intermodulation, and facilitates the antenna to achieve a higher degree of isolation; 3) a cross slotted structure or a cross stripped copper structure disposed at a radiation structure facilitates impedance matching and frequency band adjustment of antenna elements.

The technical content and the technical feature of the present disclosure are explained above. However, those of skill in the art can still make replacements and modifications without departing from the spirit of the present disclosure based on teachings and disclosure of the present invention. Therefore, the scope of the present invention should not be limited to the content disclosed by embodiments but should include various replacements and modifications without departing from the present invention and are subject to the scope of the claims.

What is claimed is:

1. A 5G antenna unit, comprising:

a feed stalk including a first support plate and a second support plate contacting the first support plate;

a radiation structure positioned at a first end of the feed stalk and including a radiation surface facing away from the first end of the feed stalk; and a feed board positioned at a second end of the feed stalk, the second end opposing the first end of the feed stalk; wherein:

the first support plate includes a first feed line and a second feed line, and the second support plate includes a third feed line and a fourth feed line;

the feed board includes a first feed point, a second feed point, a third feed point, and a fourth feed point; and the first feed point is electrically connected to the first feed line, the second feed point is electrically connected to the second feed line, the third feed point is electrically connected to the third feed line, and the fourth feed point is electrically connected to the fourth feed line.

2. The 5G antenna unit according to claim 1, wherein:

the radiation structure is provided with a director on which the radiation surface is formed.

3. The 5G antenna unit according to claim 1, wherein:

the radiation structure is a printed circuit board (PCB), an electroplated plastic plate, or a sheet metal plate.

4. The 5G antenna unit according to claim 1, wherein:

the radiation structure is provided with a slotted structure or a stripped copper structure that concaves at a thickness direction of the radiation structure.

5. The 5G antenna unit according to claim 1, wherein:

one end of each of the first and the second support plates is provided with fixing protrusions;

the radiation structure is provided with snap slots; and the fixing protrusions are snapped into the snap slots to fixedly connect the first and the second support plates to the radiation structure.

6. The 5G antenna unit according to claim 5, wherein:

a soldering pad is provided at a periphery of each snap slot on the radiation surface; and each of the fixing protrusions is glued to or soldered to the soldering pad.

7. The 5G antenna unit according to claim 1, wherein a first slot is positioned on the first support plate with an opening directed toward the feed board, a second slot is positioned on the second support plate with an opening directed toward the radiation structure, and the opening of the first slot is received through the opening of the second slot so as to engage the first support plate with the second support plate.

8. The 5G antenna unit according to claim 1, wherein at least one of the first feed line, the second feed line, the third feed line, and the fourth feed line includes a first part, a second part, and a third part, wherein the second part is positioned between the first part and the third part, and connects the first part with an angle and connects the third part with another angle.

9. The 5G antenna unit according to claim 1, wherein a cross slotted copper structure is positioned on the radiation structure, the cross slotted copper structure superimposes a center of the radiation structure but is spaced apart from an outer perimeter of the radiation structure.

10. A 5G antenna, comprising: at least one 5G antenna unit, wherein the at least one 5G antenna unit includes:

a feed stalk including a first support plate and a second support plate contacting the first support plate;

a radiation structure positioned at a first end of the feed stalk and including a radiation surface facing away from the first end of the feed stalk; and a feed board positioned at a second end of the feed stalk, the second end opposing the first end of the feed stalk; wherein:

the first support plate includes a first feed line and a second feed line, and the second support plate includes a third feed line and a fourth feed line;

the feed board includes a first feed point, a second feed point, a third feed point, and a fourth feed point; and the first feed point is electrically connected to the first feed line, the second feed point is electrically connected to the second feed line, the third feed point is electrically connected to the third feed line, and the fourth feed point is electrically connected to the fourth feed line.

11. The 5G antenna according to claim 10, wherein:

the radiation structure is provided with a director on which the radiation surface is formed.

12. The 5G antenna according to claim 10, wherein:

the radiation structure is one of a printed circuit board (PCB), an electroplated plastic plate, or a sheet metal plate.

13. The 5G antenna according to claim 10, wherein:

the radiation structure is configured with a slotted structure or a stripped copper structure that concaves at a thickness direction of the radiation structure.

14. The 5G antenna according to claim 10, wherein:

one end of each of the first and the second support plates is provided with fixing protrusions;

the radiation structure is provided with snap slots; and the fixing protrusions are snapped into the snap slots to fixedly connect the first and the second support plates to the radiation structure.

15. The 5G antenna according to claim 14, wherein:

a soldering pad is provided at a periphery of each snap slot on the radiation surface; and each of the fixing protrusions is glued to or soldered to the soldering pad.

* * * * *